US006783197B1

(12) United States Patent
Balogh

(10) Patent No.: US 6,783,197 B1
(45) Date of Patent: Aug. 31, 2004

(54) STORAGE SYSTEM MADE OF CARDBOARD

(76) Inventor: András Balogh, H-2000 Szentendre, Alkotmany u. 7., Szentendre (HU), 2000

( * ) Notice: Subject to any disclaimer, the term of this patent is extended or adjusted under 35 U.S.C. 154(b) by 74 days.

(21) Appl. No.: 10/111,589

(22) PCT Filed: Oct. 25, 2000

(86) PCT No.: PCT/HU00/00112

§ 371 (c)(1),
(2), (4) Date: Apr. 25, 2002

(87) PCT Pub. No.: WO01/30200

PCT Pub. Date: May 3, 2001

(30) Foreign Application Priority Data

Oct. 25, 1999 (HU) ..... 9903802

(51) Int. Cl.[7] ..... A47B 43/00
(52) U.S. Cl. ..... 312/259; 312/265.5
(58) Field of Search ..... 312/257.1, 258, 312/259, 262, 263, 265.5, 265.6

(56) References Cited

U.S. PATENT DOCUMENTS

| | | | | | |
|---|---|---|---|---|---|
| 2,159,069 | A | * | 5/1939 | Zalkind | 312/259 |
| 2,396,140 | A | * | 3/1946 | Zalkind | 312/259 |
| 2,552,158 | A | * | 5/1951 | Du Boff | 312/262 |
| 2,600,050 | A | | 6/1952 | Du Boff et al. | |
| 2,805,909 | A | * | 9/1957 | Derman | 312/259 |
| 4,124,260 | A | * | 11/1978 | Bergman | 312/259 |
| 4,239,306 | A | | 12/1980 | Klaus | |
| 4,519,318 | A | | 5/1985 | Weldon-Ming | |
| 4,942,830 | A | * | 7/1990 | Macaluso et al. | 108/162 |
| 5,315,936 | A | * | 5/1994 | Smith | 312/259 |
| 5,456,531 | A | * | 10/1995 | Beals | 312/330.1 |
| 5,458,411 | A | * | 10/1995 | Moss | 312/259 |
| 5,655,462 | A | * | 8/1997 | Holler | 312/262 |
| 5,669,683 | A | | 9/1997 | Moss et al. | |
| 6,039,417 | A | * | 3/2000 | Snoke et al. | 312/257.1 |

FOREIGN PATENT DOCUMENTS

| | | | |
|---|---|---|---|
| GB | 2258218 | * | 2/1993 |
| JP | 408258870 | * | 10/1996 |
| JP | 11198926 | * | 7/1999 |

* cited by examiner

*Primary Examiner*—Lanna Mai
*Assistant Examiner*—Hanh V. Tran
(74) *Attorney, Agent, or Firm*—Kirkpatrick & Lockhart LLP; Anthony H. Handal

(57) ABSTRACT

A storage system made of cardboard comprising a load bearing structure defining a rectangular storage space and storage elements in the structure, wherein the load bearing structure is a mantle having a U-shaped profile and vertical boundary plates, the mantle (1) comprises a rear plate (2), a pair of side plates (3, 4) and reinforcement beams (5, 6) constituting extension of the side plates and defines at both sides together with the rear plate (2) and side plates (3, 4) respective U-shaped vertical channels open towards inner direction; further comprises upper and lower cross reinforcement members (11*a*, 11*b*) fixed to the mantle (1) and close the channels. The channels receive spacing members and the storage elements being generally shelves.

19 Claims, 2 Drawing Sheets

STORAGE SYSTEM MADE OF CARDBOARD

The invention relates to a storage system made of cardboard, which comprises a load bearing structure defining a rectangular storage space and storage elements in the structure. The appearance of the storage system is similar to a wardrobe, and the storage elements are shelves or slant display shelves.

For storage purposes, in offices or for expositions light weight storage systems are required which can easily be assembled and disassembled and which are capable of storing files, exposition objects and leaflets as well as books. The building material of such systems can also be a stiff and strong cardboard.

The use of cardboard storage systems is preferable due to the low price and weight of paper and to the easy way of making any desired surface finish there on. Up to the present cardboard storage systems has not been used which have the required strength and can be manufactured and assembled easily.

In the Hungarian patent application P 97 00488 published on Mar. 29, 1999 a storage system is described that has several shelves and comprises a body made of a cardboard sheet folded to take the final form, wherein the shelves are fitted in the body. Such a design has drawbacks because one has to know the location of the shelves already at the time of manufacture, since respective openings should be made on the wall material for the fitting of the shelves. The cutting step as an operation is expensive, it requires the application of a tool, and the predetermined arrangement decreases variability. The fixing of the shelves in openings decreases the mechanical stability and strength. A further drawback of such a system lies in that the system will assume its final stability only after the shelves have been inserted. Owing to the lack of the required stability such a design is inappropriate for making systems of any desired size and shape.

In the catalogue "Pre-Designed Displays" of the U.S. company Meridian Display and Merchandising (162 York Ave E. St. Paul Minn.) numerous merchandisers are shown which are made of paper material and comprise shelves fixed in openings made in the wall of the cabinet. The material of the cabinet should be provided with openings at locations where shelves will have to be fitted. Such storage systems are sufficiently strong and loadable owing to the sophisticated design of the cabinet walls including reinforcement elements.

The object of the invention is to provide a cardboard storage system that has the required strength and which can be manufactured from a simple cardboard plate by using assembling technology, wherein the storage elements can be arranged freely and any arrangement can be varied easily. A further object lies in the design of a storage system, wherein at least in the larger parts mainly on the support elements there is no need for making any openings, furthermore wherein the assembly and disassembly can be made repeatedly without the danger of any injury to the elements.

These objects have been attained by a storage system made of cardboard that comprises a load bearing structure defining a rectangular storage space and storage elements in the structure, wherein the load bearing structure is a mantle having a U-shaped profile and vertical boundary plates, the mantle comprises a rear plate, a pair of side plates and reinforcement beams constituting extension of the side plates, and defining at both sides together with the rear plate and the side plates respective U-shaped vertical channels open towards inner direction; further it comprises upper and lower cross reinforcement members fixed to the mantle which close the channels, and the channels receive spacing members and the storage elements.

In a preferable embodiment the mantle is a structure made of a cardboard plate by means of folding; the reinforcement beams have rectangular cross section and being folded back to the associated one of the side plates and fixed thereto.

The cross reinforcement members are made of cardboard by means of folding and have a rectangular profile, each comprises a horizontal closing surface filling the interior of the mantle and a pair of vertical side plates attached to the rear plate and to the inner surface of said reinforcement beams, respectively.

The spacing members are preferably made of cardboard by means of folding and they have a U-profile or a closed cross section and have a plate that closes the inward opening of the channel and a pair of shorter sides attached to the shorter sides of said channel the spacing members fill the vertical channels between the storage elements and provide support therefor.

The storage elements are preferably shelves made of cardboard by means of folding and they have a closed cross section, the shelves fill and interconnect the channels and are supported by the spacing members and in given cases support further spacing members.

In an alternative embodiment the storage elements are slant shelves, each comprises a rear plate that extends into the channels and held by said the spacing members, a slant support plate and a narrow lower edge normal to the slant support plate, these elements are made of a cardboard plate material by multiple folds and united into a stiff structure.

The assembly will be much easier if the constructional elements are clamped and fixed together by pressure clips arranged at locations being invisible during normal use.

It is preferable if openings are made in the structural elements for the easy insertion of the pressure clips.

The storage system according the invention attains all objectives set, the constructional frame is sufficiently stiff and rigid and enables the free arrangement of the support elements. All elements are made by multiple folds without using openings that would depend on the intended arrangement The attachment by means of pressure clips guarantees the easy and repeated assembly.

The invention will now be described by preferable embodiments thereof, in which reference will be made to the accompanying drawings. In the drawing.

Figure 11:
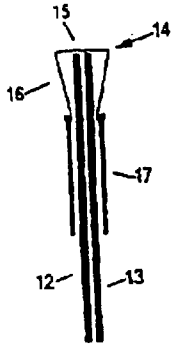
FIG. 11 is a sketch illustrating the attachment of two plates by a pressure clip.

The furniture according to the invention can be assembled from a plurality of elements attached to each other. During the design work attention was paid that the joining elements engage each other along large surfaces, and the task of position fixing lies merely in pressing the engaging surfaces to each other that prevents their relative displacement. The transmission of the load does not occur through the pressing members. An appropriate pressing member can be the commonly used binder clip used in offices to bind documents with a large number of sheets, which has a pair of pivotally mounted handles and a body made of a generally black steel sheet material. FIG. 11 shows the edge regions of a pair of cardboard sheets 12, 13 and pressure clip 14 connecting the sheets together. The pressure clip 14 comprises an end portion 15 normal to the surface of the sheets and respective slant pressing sheets 16 extending out from the end portion 15. The edges of the pressing sheets 16 are folded back so that the interior of the circular folds engage respective handles 17 made of a spring material and bent in the form of a loop. In pressing position the handles 17 abut the sheet surfaces and require very small place. The opening of the pressure clip 14 occurs by the turning back of the handles 17 followed by pressing them towards each other. In the assembly according to the invention the pressure clips 14 are put in hidden places invisible for the users of the furniture. The connection between the constructional elements by means of pressure clips is preferable because they are made in large quantities, thus they are cheaper, and their use facilitates assembly and disassembly of the furniture, which can also have variable functions and mode of assembly.

Instead of using the pressure clip 14 the abutting surfaces can of course be fixed to each other by means of adhesive bonding. Such a fixing requires, however, a longer time, the parts cannot be disassembled, therefore the function cannot be changed.

Figure 1:
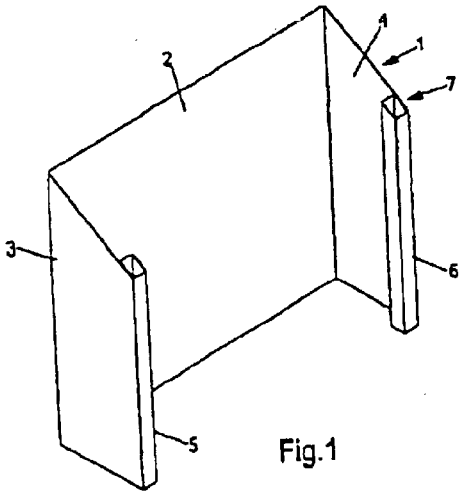
FIG. 1 shows a detail of the mantle of the storage system in perspective view.
Figure 2:
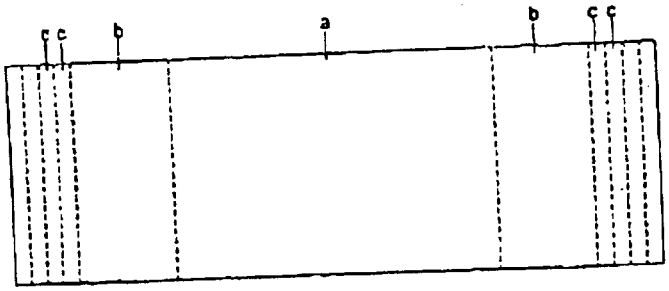
FIG. 2 is the spread view of a detail of the mantle.

The furniture according to the invention has a main support element constituted by mantle 1 shown both in FIGS. 1 and 2. The mantle 1 is an U-shaped vertically extending body open at the front side and it comprises a rear plate 2, a pair of side plates 3, 4 and respective reinforcement beams 5, 6 provided by folding back of the inner ends of the sides. The mantle 1 is made of a single cardboard plate by a plurality of folding steps. A portion of the starting material is shown in FIG. 2, wherein the pre-pressed fold lines can be seen. The spacing between the pre-pressed lines that determine the edges of the folds are as follows:

a—the width of the rear plate 2 b—the width of the side plates 3, 4 c—the width of the rectangular column constituted by reinforcement beams 5, 6 d—a size being by the material thickness smaller than the size c.

The material of the reinforcement beams 5, 6 folded to form a column is fixed at their open upper and lower ends to the side plates 3, 4 by means of respective pressure clips applied at locations shown by arrow 7 in FIG. 1.

Figure 3:
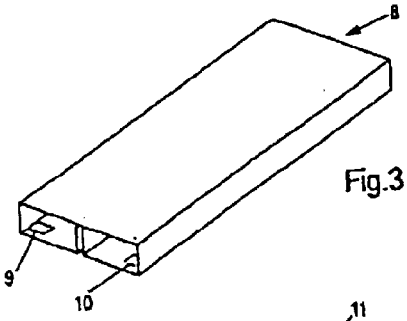
FIG. 3 is a perspective view of the cross reinforcement member 8.
Figure 4:
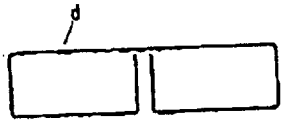
FIG. 4 shows the cross sectional profile of the cross reinforcement member 8.
Figure 5:
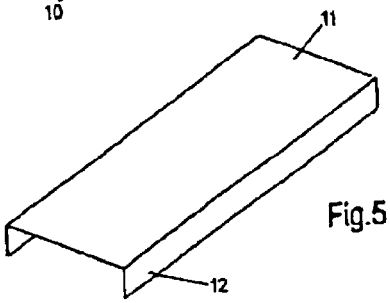
FIG. 5 shows an alternative cross section.

FIGS. 3 to 5 show two alternative designs of cross reinforcement member 8. FIGS. 3 and 4 show the embodiment designed for higher load. The cross reinforcement member 8 has a flat stiff body with a length identical to the spacing between the inner surfaces of the side plates 3, 4, which is: a—2t, where t designates the thickness of the plate material. The width of the reinforcement member 8 corresponds to the spacing between the inner surfaces of the rear plate 2 and of the reinforcement beams 5 and 6, i.e. it is b—c—2t.

In the outer regions of a wide surface of the cross reinforcement member 8 four rectangular openings are provided of which openings 9 and 10 can be seen in FIG. 3. The cross reinforcement members 8 close the upper and lower ends of the vertical cavity defined by the mantle 2, and the side surfaces defining the openings 9 and 10 will always face outwardly, whereby they will be adjacent with the open cavity of the reinforcement beams 5 and 6.

Figure 6:
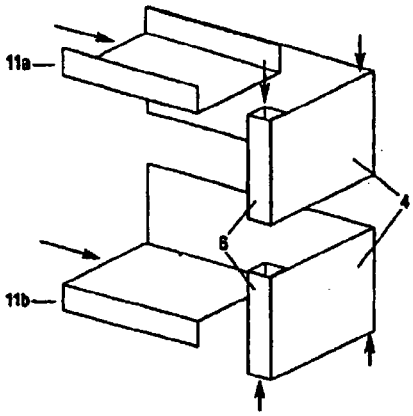
FIG. 6 shows how the cross reinforcement members are inserted in the mantle.

The upper and the lower cross reinforcement members 8 can be fixed to the mantle 1 by the application of four pressure clips inserted through the outwardly (at the upper end upwards and at the lower end downward) facing adjacent openings. FIG. 4 illustrates the cross-sectional profile of the cross-reinforcement member 8, wherein the spacing between neighboring sides has been shown for the sake of illustration only. FIG. 5 shows an alternative design of a cross-reinforcement member 11 that can be used for lower and medium range of load, which has a simple U-profile, and its placement is similar to that of the previous embodiment illustrated in FIG. 6. The upper cross-reinforcement member 11*a* is attached to the upper end of the side plate 4 of the mantle 1 in such a way that the U-shaped profile will be open in upward direction, while the lower cross-reinforcement member 11*b* is open in downward direction and it is attached to the lower end of the side plate 4. The pressure clips are inserted from the direction of the open ends at locations indicated by the short vertical arrows. At each of the sides the cross-reinforcement members 11*a* and 11*b* are clamped at two locations to the rear plate 2 and to the open ends of the reinforcement beams 5 and 6, respectively. In the assembled furniture no one of the clips can be seen, because they are at covered locations.

Figure 7:
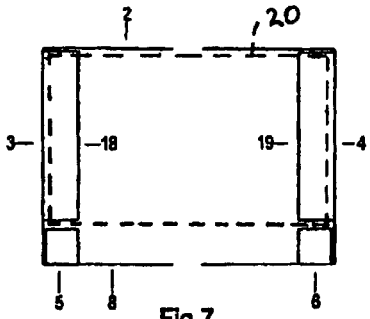
FIG. 7 is a sectional view showing the placement of spacing members 18, 19.
Figure 8:
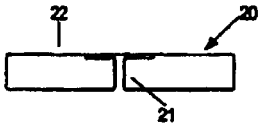
FIG. 8 shows the cross sectional profile of a shelf.

By using the cross-reinforcement members 8 or 11 the mantle 1 has become a self-containing wardrobe which can normally be loaded. This wardrobe constitutes a frame structure in which shelves 20 shown in FIG. 8 can be placed by means of spacing members 18, 19 shown in FIG. 7. The spacing members 18, 19 extend in vertical direction and have U-profile which accurately fit in the two U-shaped channels formed at both sides between the rear-plate 2, the respective ones of the side plates 3, 4 and the reinforcement beams 5, 6. The height of the spacing member 18, 19 can be chosen according to the required internal design of the furniture. The assembly of the elements should take place before the upper cross-reinforcement member 11*a* is fixed and the wardrobe is still open from the upper direction. First the lowermost spacing members 18, 19 should be slid down to take the position shown in FIG. 7, and their lower ends abut the lower cross-reinforcement member 8 or 11*b*. The height of the lower spacing members 18, 19 determines the required position of the first shelf 20. The cross section of the shelves 20 is shown in FIG. 8. The shelves 20 made by multiple folding steps from a rectangular cardboard material are stiff structures that can be exposed to high loads. They will take a stiff closed form when the centrally extending vertical rib plates 21 are clamped together by appropriate pressure clips inserted from the direction of the open ends or they can be attached together by the use of conventional adhesives. The length of the shelves 20 corresponds to the spacing between the inner surfaces of the side plates 3, 4 of the mantle 1. Their width is equal to the width of the spacing members 18, 19, therefore the shelf 20 can be inserted and slid along the aforementioned vertical channels and its two ends will be supported by the two spacing members 18, 19 underneath. Support surface 22 of the shelf 20 is completely free, no attachment or fixing member can be seen thereon.

For the placement of the next shelf or shelves further spacing members should be inserted. The height of these spacing members defines the spacing between the shelves. By the end of the assembly of the shelves the two U-shaped channels formed at the two side plates 3, 4 will be filled by the spacing members and the shelves and closed from upward direction by the upper cross reinforcement member 8 or 11*a*. In case if a hanger rod should be arranged in the wardrobe, this can be solved by providing respective holes in the spacing members 18, 19 at the desired height to receive ends of the rod.

Figure 9:
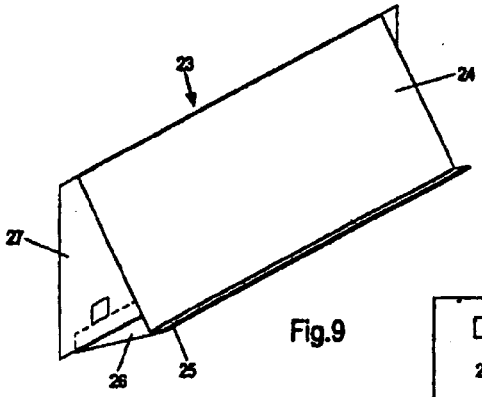
FIG. 9 shows the perspective view of a slant shelf 23.
Figure 10:
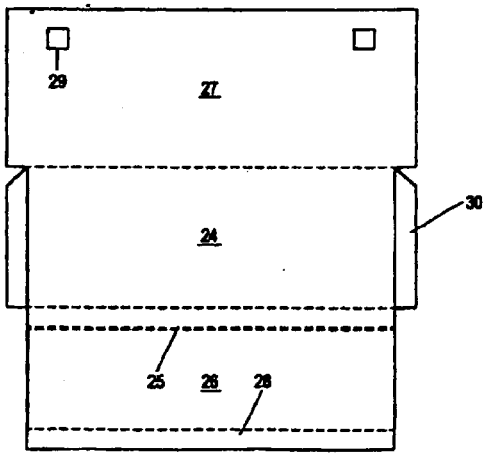
FIG. 10 shows the spread view of a slant shelf.

The furniture can be used for display purposes. For such applications slant shelves 23 shown in FIG. 9 and capable of holding exhibition documents should be arranged on the spacing members 18, 19. The slant shelf 23 comprises an inclined support plate 24, a forwardly projecting short lower edge 25 being normal to the support plate 24, a bottom plate 26 and the rear plate 27 which latter has a length corresponding to the length of the shelf 20. The spread plan view of the slant shelf 23 prior to folding its shown in FIG. 10. In the spread top view it can be seen that the rear plate 27 is wider than the other portions, and in addition to the subsequent adjacent plates there is a need for a stripe 28 folded back and being fixed to the rear plate 27. The fixing of the stripe 28 to the rear plate 27 can be made by means of pressure clips that can be inserted through rectangular openings 29 made in the rear plate 27. Alternatively, the stripe 28 can be connected to the rear plate 27 by means of an adhesive. For attaining sufficient rigidity a pair of reinforcement tabs 30 are made at the two sides of the support plate 24. The slant shelf 23 is held by the spacing members 18, 19 on which the lower edge of the rear plate 27 is placed. In case of greater weights the upper portion of the spacing members 18, 19 can be designed to have an inclination corresponding to that of the bottom plate 26, whereby the support surface will be greater.

The structure according to the invention can be assembled easily, it has the required versatility in design, and the constituting elements can be packed in planar form so that the demand on space at transportation will be very low. The assembly can take place on the site by means of the pressure clips. Owing to the simple design and the use of cheep materials the structure will be inexpensive, its performance is, however, equivalent to that of the more expensive furniture. It should also be noted that by using state of the art paints the structure can be made in any desired color and surface appearance, furthermore printed information (inscriptions, pictures) can easily be provided on the exposed surfaces.

What is claimed is:

1. A storage system made of cardboard comprising:

a load bearing structure defining a rectangular storage space, the load-bearing structure being formed of cardboard members and the cardboard members comprising:

a vertically extending mantle having:

a U-shaped horizontal form;

a vertical rear plate;

a pair of vertical side plates extending from the rear plate, the rear plate and the side plates providing the U-shaped form;

side plate extensions providing vertically extending reinforcement members formed by folding back the side plate extensions about multiple parallel and spaced folds;

a pair of vertically extending U-shaped lateral channels, each channel being defined by one of the side plates, one of the vertically extending reinforcing members and the rear plate, the lateral channels facing inwardly of the mantle and toward another; and upper and lower end regions;

upper and lower horizontal cross reinforcement members extending between the side plates and having end portions received in the lateral channels, the cross reinforcement members being fixed to the upper and lower end regions of the mantle respectively;

at least one horizontally disposed storage element extending between the side plates and having end portions received in the lateral channels; and at least one pair of load-bearing vertical spacing members, one spacing member of each pair being disposed in each of the lateral channels to bear downwardly on the lower cross reinforcement members at a first end while upwardly supporting the storage element at a second end or to bear downwardly on the storage element at a first end, while upwardly supporting the upper cross reinforcement member at a second end.

2. A storage system according to claim 1 wherein the mantle is constituted by folded non-punched continuous sheet material.

3. A storage system according to claim 1 wherein the cross reinforcement members have a rectangular transverse profile and each comprise a folded cardboard sheet providing a horizontal mantle closing panel and a pair of vertical side panels, one of the side panels being fixed to the mantle rear plate and the other side panel being fixed to the vertical reinforcement members.

4. A storage system according to claim 1 wherein each spacing member has a U-shaped or closed-loop transverse profile and each spacing member comprises a folded cardboard sheet providing a closing panel to close a respective one of the lateral channels and a has pair of side panels, one side panel on each side of the closing panel, the side panels being attachable to the sides of the lateral channel.

5. A storage system according to claim 1 wherein the or each storage element is a shelf extending into and interconnecting the lateral channels and comprises a folded cardboard sheet having a closed loop transverse cross-section and being capable of supporting a further pair of the spacing members.

6. A storage system according to claim 1 wherein the or each storage element comprises a slanted shelf comprising a rear plate extending into the lateral channels and supported on a pair of the spacing members, a slanted support plate and a narrow lower edge transverse to the slanted support plate, the slanted shield being formed of cardboard sheet material having multiple folds and formed to provide a stiff structure.

7. A storage system according to claim 1 wherein the cardboard members of the load bearing structure are clamped and held together by pressure clips disposed to be invisible during use of the system for storage.

8. A storage system according to claim 7 comprising openings formed in the cross reinforcement members and in the or each storage element to facilitate insertion of the pressure clips.

9. A storage system according to claim 3 wherein the cardboard members of the load bearing structure are clamped and held together by pressure clips disposed to be invisible during use of the system for storage and wherein the cross reinforcement members each have openings to facilitate insertion of the pressure clips.

10. A storage system according to claim 5 wherein the cardboard members of the load bearing structure are clamped and held together by pressure clips disposed to be invisible during use of the system for storage and wherein the or each storage element has openings to facilitate insertion of the pressure clips.

11. A storage system according to claim 1 wherein the vertical reinforcement members comprise hollow structures, optionally having a rectangular cross section.

12. A storage system according to claim 3 wherein each spacing member has a U-shaped or closed-loop transverse profile and each spacing member comprises a folded cardboard sheet providing a closing panel to close a respective one of the lateral channels and has a pair of side panels, one side panel on each side of the closing panel, the side panels being attachable to the sides of the lateral channel.

13. A storage system according to claim 12 wherein the cardboard members of the load bearing structure are clamped and held together by pressure clips disposed to be invisible during use of the system for storage and wherein the cross reinforcement members and the or each storage element have openings to facilitate insertion of the pressure clips.

14. A storage system according to claim 3 wherein the or each storage element is a shelf extending into and interconnecting the lateral channels and comprises a folded cardboard sheet having a closed loop transverse cross-section and being capable of supporting a further pair of the spacing members.

15. A storage system according to claim 12 wherein the or each storage element is a shelf extending into and interconnecting the lateral channels and comprises a folded cardboard sheet having a closed loop transverse cross-section and being capable of supporting a further pair of the spacing members.

16. A storage system according to claim 15 wherein the cardboard members of the load bearing structure are clamped and held together by pressure clips disposed to be invisible during use of the system for storage and wherein the cross reinforcement members and the or each storage element have openings to facilitate insertion of the pressure clips.

17. A storage system according to claim 1 capable of assembly and disassembly, optionally without requiring tools, wherein the or each storage element is accessible through the open end of the U-shaped form between the side plates, wherein the pressure clips are manually installable and removable wherein the vertically extending lateral channels are filled between the cross reinforcement members by the storage elements and the spacing members and wherein all the horizontal members can be fitted in the vertically extending U-shaped lateral channels so that the lateral ends of the members reach to the inner surface of the side walls.

18. A storage system made of cardboard comprising:

a load bearing structure defining a rectangular storage space, the load-bearing structure being formed of cardboard members and the cardboard members comprising:

a vertically extending mantle having:

a U-shaped horizontal form;

a vertical rear plate;

a pair of vertical side plates extending from the rear plate, the rear plate and the side plates providing the U-shaped form;

side plate extensions providing vertically extending reinforcement members formed by folding back the side plate extensions about multiple parallel and spaced folds;

a pair of vertically extending U-shaped lateral channels, each channel being defined by one of the side plates, one of the vertically extending reinforcing members and the rear plate, the lateral channels facing inwardly of the mantle and toward another; and upper and lower end regions;

upper and lower horizontal cross reinforcement members extending between the side plates and having end portions received in the lateral channels, the cross reinforcement members being fixed to the upper and lower end regions of the mantle respectively;

at least one horizontally disposed storage element extending between the side plates and having end portions received in the lateral channels; and at least one pair of load-bearing vertical spacing members, one spacing member of each pair being disposed in each of the lateral channels to bear downwardly on the lower cross reinforcement member at a first end while upwardly supporting the storage element at a second end or to bear downwardly on the storage element at a first end, while upwardly supporting the upper cross reinforcement member at a second end, wherein the cardboard members of the load bearing structure are clamped and held together by pressure clips disposed to be invisible during use of the system for storage.

19. A storage system made of cardboard comprising:

a load bearing structure defining a rectangular storage space, the load-bearing structure being formed of cardboard members and the cardboard members comprising:

a vertically extending mantle having:

a U-shaped horizontal form;

a vertical rear plate;

a pair of vertical side plates extending from the rear plate, the rear plate and the side plates providing the U-shaped form;

side plate extensions providing vertically extending reinforcement members formed by folding back the side plate extensions about multiple parallel and spaced folds;

a pair of vertically extending U-shaped lateral channels, each channel being defined by one of the side plates, one of the vertically extending reinforcing members and the rear plate, the lateral channels facing inwardly of the mantle and toward another; and upper and lower end regions;

upper and lower horizontal cross reinforcement members extending between the side plates and having end portions received in the lateral channels, the cross reinforcement members being fixed to the upper and lower end regions of the mantle respectively;

at least one horizontally disposed storage element extending between the side plates and having end portions received in the lateral channels; and at least one pair of load-bearing vertical spacing members, one spacing member of each pair being disposed in each of the lateral channels to bear downwardly on the lower cross reinforcement member or on said storage element while upwardly supporting the storage element or the upper cross reinforcement member wherein the cardboard members of the load bearing structure are clamped and held together by pressure clips disposed to be invisible during use of the system for storage and the storage system comprises openings formed in the cross reinforcement members and in the storage element to facilitate insertion of the pressure clips.

* * * * *